US010811810B2

(12) United States Patent
Nishijima

(10) Patent No.: US 10,811,810 B2
(45) Date of Patent: Oct. 20, 2020

(54) CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Seidou Nishijima, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/481,865

(22) PCT Filed: Jan. 25, 2018

(86) PCT No.: PCT/JP2018/002223
§ 371 (c)(1),
(2) Date: Jul. 30, 2019

(87) PCT Pub. No.: WO2018/139515
PCT Pub. Date: Aug. 2, 2018

(65) Prior Publication Data

US 2019/0379154 A1 Dec. 12, 2019

(30) Foreign Application Priority Data

Jan. 30, 2017 (JP) ..... 2017-014095

(51) Int. Cl.
*H01R 13/52* (2006.01)
*H01R 13/40* (2006.01)
*H01R 13/512* (2006.01)

(52) U.S. Cl.
CPC ..... *H01R 13/5202* (2013.01); *H01R 13/40* (2013.01); *H01R 13/512* (2013.01)

(58) Field of Classification Search
CPC ... H01R 13/5202; H01R 13/40; H01R 13/512
(Continued)

(56) References Cited

U.S. PATENT DOCUMENTS 5,163,335 A * 11/1992 Isom ..... F02N 15/006 123/195 A
7,789,690 B1 * 9/2010 Rhein ..... H01R 13/53 439/310

(Continued)

FOREIGN PATENT DOCUMENTS

JP 57-163166 10/1982
JP 2011-023290 2/2011

(Continued)

OTHER PUBLICATIONS

International Search Report dated Mar. 13, 2018.

*Primary Examiner* — Alexander Gilman
(74) *Attorney, Agent, or Firm* — Gerald E. Hespos; Michael J. Porco; Matthew T. Hespos

(57) ABSTRACT

A connector (10) in a first device is connected to a mating connector (80) in a second device while overlapping and fixing the devices. The connector (10) includes a terminal holding portion (30) to hold terminals (20). A flange (40) on an outer periphery of the terminal holding portion (30) is sandwiched between cases (60, 90) of the devices. A first seal (50A) is mounted on a surface of the flange (40) facing the first device and seals between an outer surface of the case (60) of the first device and the flange (40), and a second seal (50B) is mounted on a surface of the flange (40) facing the second device and seals between an outer surface of the case (90) of the second device and the flange (40). Mounted (Continued)

positions of the seals (50A, 50B) are aligned in an overlapping direction of the first and second devices.

9 Claims, 11 Drawing Sheets

(58) Field of Classification Search
USPC ..... 439/587
See application file for complete search history.

(56) References Cited

U.S. PATENT DOCUMENTS 8,192,212 B2 * 6/2012 Casses ..... H01R 13/6272 439/181
8,245,681 B2 * 8/2012 Wanner ..... F02N 15/006 123/179.25
8,951,065 B2 * 2/2015 Tsuge ..... H01R 13/631 439/559
9,039,452 B2 * 5/2015 Sakaizawa ..... H01R 13/518 439/626
9,441,819 B2 * 9/2016 Randolph ..... F21K 9/00
9,455,525 B2 * 9/2016 Uno ..... H01R 13/533
9,490,570 B1 * 11/2016 Hashiguchi ..... H01R 13/502
9,728,901 B2 * 8/2017 Mukuno ..... H01R 13/6584
9,966,715 B2 * 5/2018 Ishibashi ..... H01R 13/424
9,997,974 B2 * 6/2018 Ishibashi ..... H02K 5/124
10,116,093 B2 * 10/2018 Ishibashi ..... H02K 5/22
10,530,094 B2 * 1/2020 Furuya ..... H01R 13/62911
10,574,001 B2 * 2/2020 Data ..... H01R 13/6592
2009/0124121 A1 * 5/2009 Matsuoka ..... H01R 4/183 439/550
2012/0003856 A1 * 1/2012 Yamaguchi ..... H01R 13/5202 439/271
2012/0015546 A1 * 1/2012 Yamaguchi ..... H01R 13/6315 439/370
2015/0357886 A1 * 12/2015 Ishizeki ..... H02K 11/04 310/71
2016/0308299 A1 * 10/2016 Mukuno ..... H01R 13/5202
2018/0006401 A1 * 1/2018 Ishibashi ..... H01R 13/621

FOREIGN PATENT DOCUMENTS

JP 2014-143897 8/2014
JP 2016-139540 8/2016

* cited by examiner

CONNECTOR

BACKGROUND

Field of the Invention

This specification relates to a connector.

Related Art

Devices, such as a motor and an inverter, are connected to each other by connectors provided in cases of the respective devices. The cases are arranged to face each other and the connectors mounted in the cases are connected to each other without using a wiring harness for space saving. In this configuration, the cases are provided with openings to mount the connectors. Sealing needs to be provided between the connectors and the respective cases so that lubricants and the like in the motor do not leak out through these openings.

Japanese Unexamined Patent Publication No. 2016-139540 discloses a connector device with a sealing member mounted on a flange made of synthetic resin and provided on a motor-side connector to provide sealing between the outer surface of a motor case and the flange. However, a resilient force of the squeezed sealing member continues to be applied to the flange. Thus, the flange may deform and a proper sealed state may not be maintained due to a resin creep phenomenon or the like. Accordingly, in this connector device, deformation of the flange is suppressed by pressing the flange by a shield shell made of metal. On the other hand, sealing is provided between the motor-side connector and the inner peripheral surface of a fitting recess open in an inverter case by a shaft seal mounted on the outer peripheral surface of a tip of the motor-side connector. A positioning mechanism is provided to align center positions between the motor-side connector and the inverter case so that the shaft seal is squeezed uniformly between the motor-side connector and the inverter case.

However, in the connector of Japanese Unexamined Patent Publication No. 2016-139540, the number of components, such as the shield shell, increases to ensure sealing performance. Further, the positioning mechanism for uniformly squeezing the shaft seal increases the number of components. The positioning mechanism also becomes a factor for enlargement of the connector. Furthermore, a surface that is to be sealed by a surface seal or a shaft seal cannot ensure sufficient sealing performance unless the surface is smooth. Thus, the inner peripheral surface of the fitting recess of the inverter case needs to be smooth. This may require the inner peripheral surface of the case to be polished, such as by boring, which becomes one factor of a cost increase.

SUMMARY

A connector disclosed in this specification is to be mounted into an opening of a case of a first device and is connected to a mating connector provided in a second device by overlapping and fixing the first device and the second device. The connector includes a terminal holding portion configured to hold a terminal. A flange in the form of a flat plate is provided on an outer periphery of the terminal holding portion and is to be sandwiched between the case of the first device and a case of the second device. A first sealing member is mounted on a surface of the flange on the side of the first device and is configured to seal between an outer surface of the case of the first device and the flange. A second sealing member is mounted on a surface of the flange on the side of the second device and is configured to seal between an outer surface of the case of the second device and the flange. Mounted positions of the first sealing member and the second sealing member are aligned in an overlapping direction of the first device and the second device.

The sealing members are mounted respectively on both surfaces of the flange and provide sealing while being squeezed between the respective cases and the flange. The mounted positions of the first and second sealing members are aligned in the overlapping direction of the first and second devices. Thus, resilient forces of the squeezed sealing members are applied in the same manner from both sides in a plate thickness direction of the flange and cancel each other. Thus, the deformation of the flange caused by the resilient forces of the sealing members can be suppressed, a member for preventing the deformation of the flange becomes unnecessary, and the number of components can be reduced. Further, sealing is provided between the flange and the respective cases by surface seals, and therefore, unlike shaft seals, a precise alignment is not necessary. Thus, an aligning mechanism becomes unnecessary and miniaturization and a cost reduction can be realized. Further, the surfaces of the cases to be held in close contact with the sealing members are the outer surfaces of the cases and a process for polishing outer surfaces is less costly than a process for polishing inner surfaces.

The first sealing member and the second sealing member may have the same shape. By forming the first sealing member and the second sealing member to have the same shape, these sealing members can be identical components and molding cost can be reduced.

The flange may be provided with a collar made of metal. A bolt for fixing the flange to the case of the first device may be inserted through the collar and a head part of the bolt may contact with the collar. An area of the flange corresponding to the head of the bolt may be recessed farther toward the case of the first device than a flange body provided with first and second mounting grooves. By recessing the area of the flange where the collar for allowing the insertion of the bolt is provided farther toward the case of the first device than the flange body, a projecting amount of the head of the bolt can be made smaller with the bolt for fixing the flange to the case of the first device inserted in the collar and held in contact with the collar.

The terminal held in the terminal holding portion may be connected to a mating terminal held in the mating connector by being butted against the mating terminal.

Accordingly, a pin-like male terminal and a tubular female terminal need not be aligned. These terminals are used together with surface seals requiring no strict alignment.

According to the connector disclosed in this specification, inexpensive production is possible while sealing performance between the cases and the connector is ensured.

DETAILED DESCRIPTION

Figure 5:
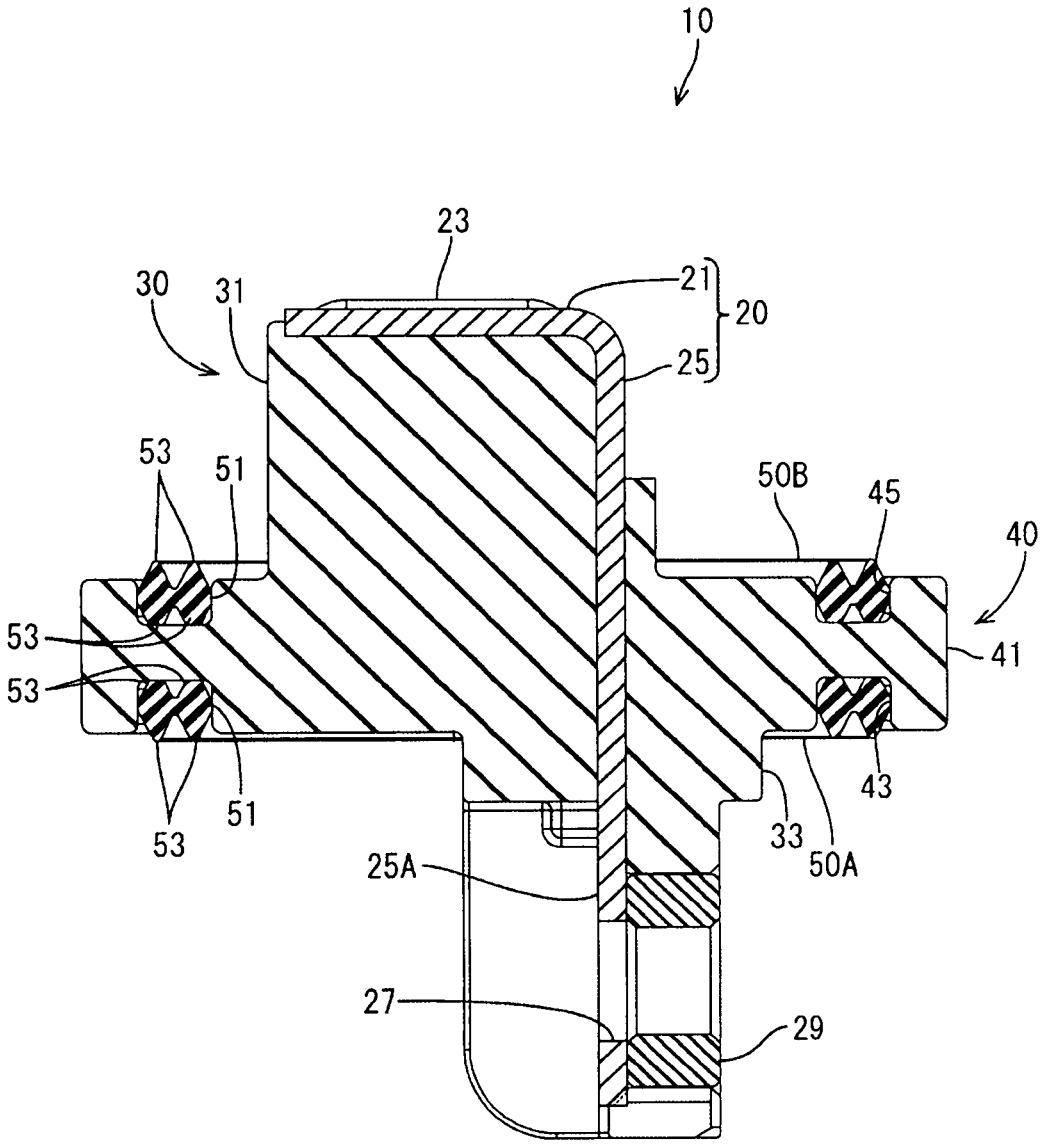
FIG. 5 is a section along V-V in FIG. 1.
Figure 6:
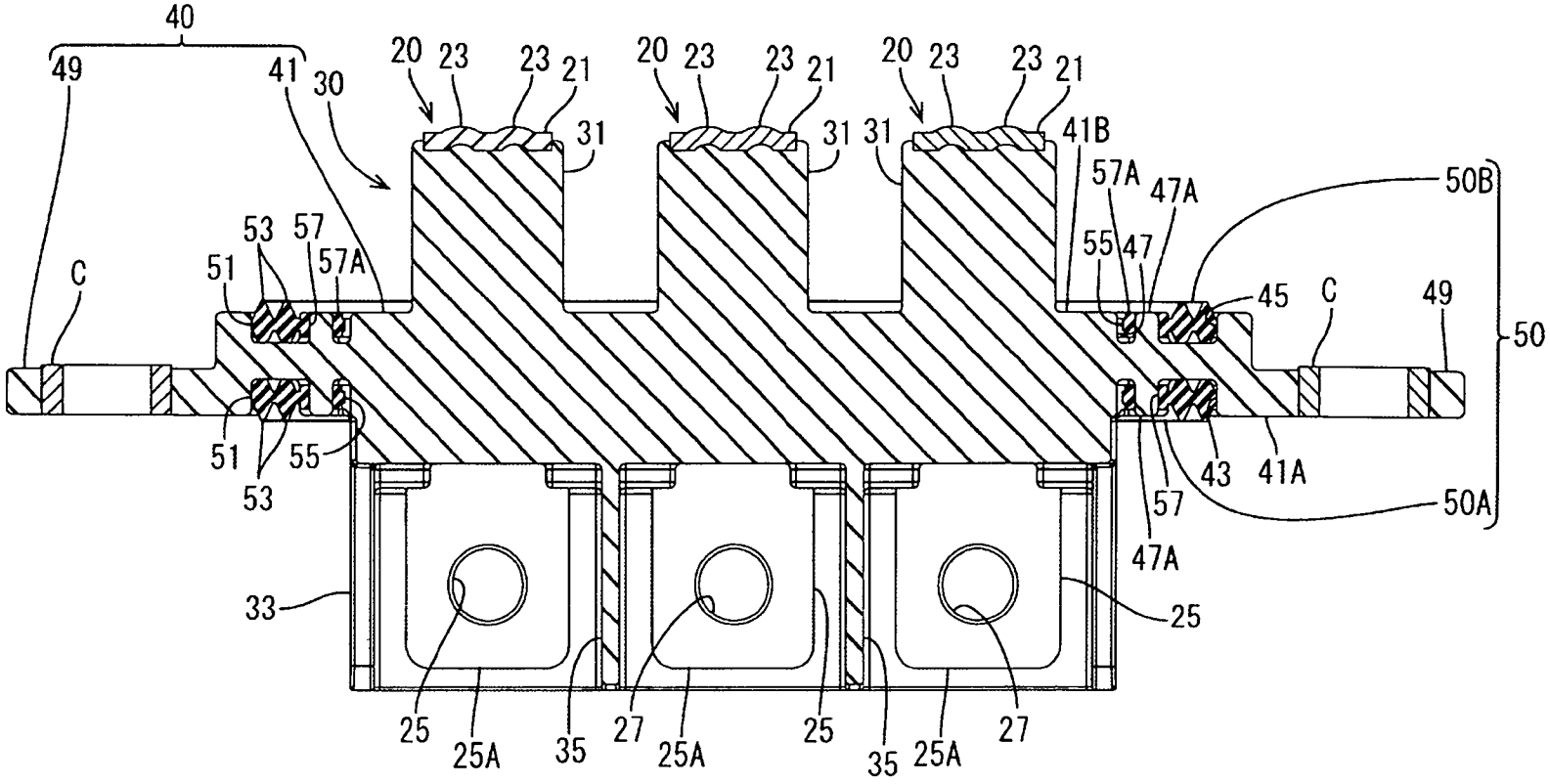
FIG. 6 is a section along VI-VI in FIG. 2.
Figure 7:
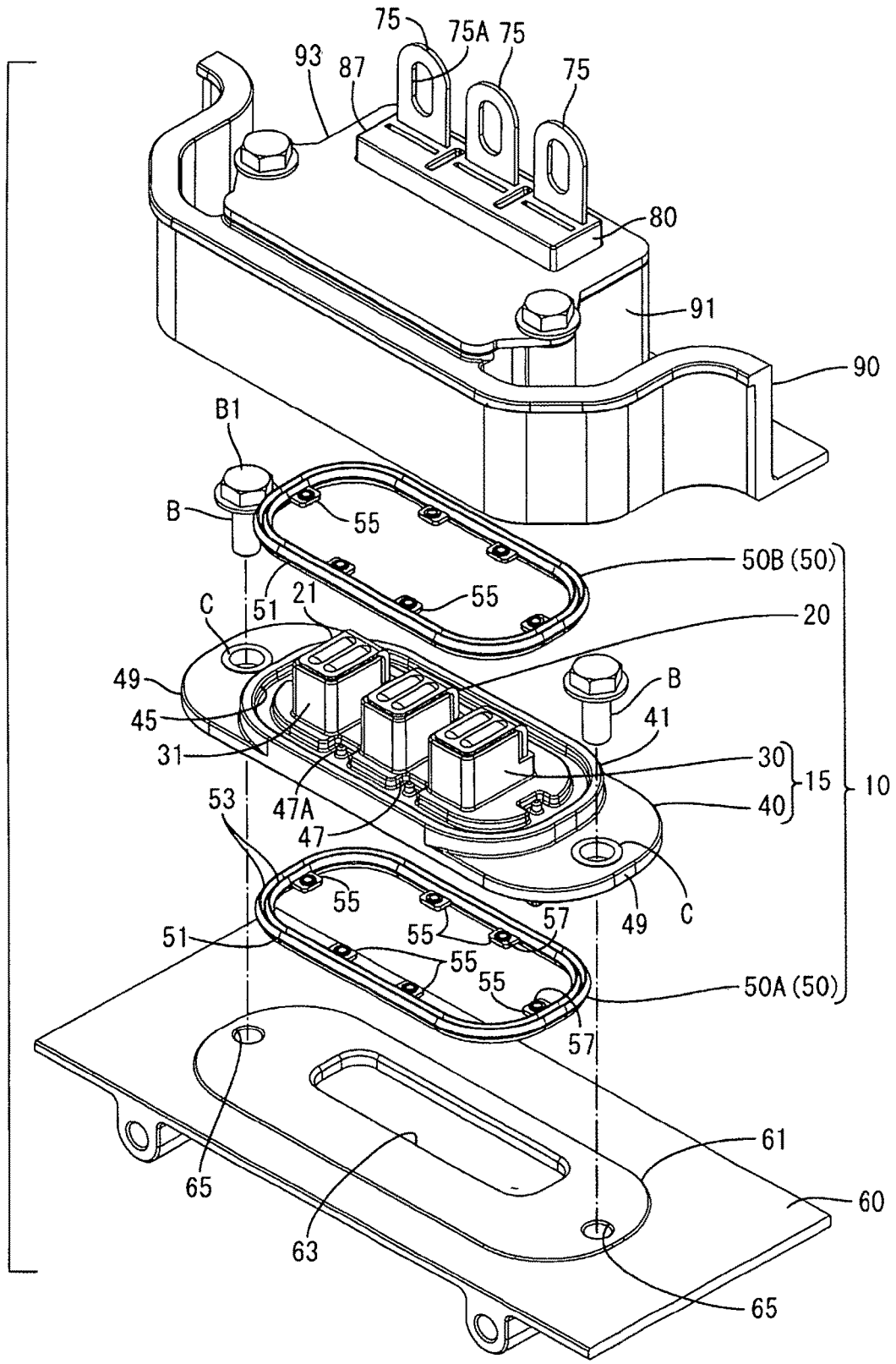
FIG. 7 is an exploded perspective view of a mating connector, a case and the connector.

An embodiment is described with reference to FIGS. 1 to 11. A connector 10 of this embodiment is mounted on a case (motor-side case 60) of a motor (an example of a "first device") as shown in FIG. 7. The connector 10 is overlapped on and fixed to an inverter PCU (an example of a "second device"; hereinafter, merely referred to as an inverter), thereby being connected to an inverter-side connector 80 (an example of a "mating connector") mounted in an inverter-side case 90. The connector 10 includes terminals 20, a connector housing 15 with a terminal holding portion 30 and a flange 40, and sealing members 50 to be mounted the flange 40.

In the following description, a vertical direction is based on FIG. 8. Note that the vertical direction is an overlapping direction of the devices and, in this embodiment, an upper side is referred to as an inverter side and a lower side is referred to as a motor side. Further, a lateral direction is based on FIG. 8 and a left side in FIG. 4 is referred to as a front side and a right side in FIG. 4 is referred to as a right side concerning a front-rear direction.

Three terminals 20 are embedded in the connector housing 15 made of synthetic resin by insert molding. As shown in FIGS. 5 and 6, each terminal 20 is L-shaped and is formed by bending a conductive metal plate extending in the vertical direction forward at a right angle. Each terminal 20 includes a connecting portion 21 to be connected to a mating terminal 70 (see FIG. 7) and an extending portion 25 extending in the vertical direction. The connecting portion 21 extends in the front-rear direction, and two elongated contact portions 23 arranged in the lateral direction are formed by being struck up. Further, a round hole 27 to be threaded into connection with a motor terminal in the motor is provided in a lower end part 25A of the extending portion 25, and a nut 29 is fixed behind the round hole 27.

Figure 1:
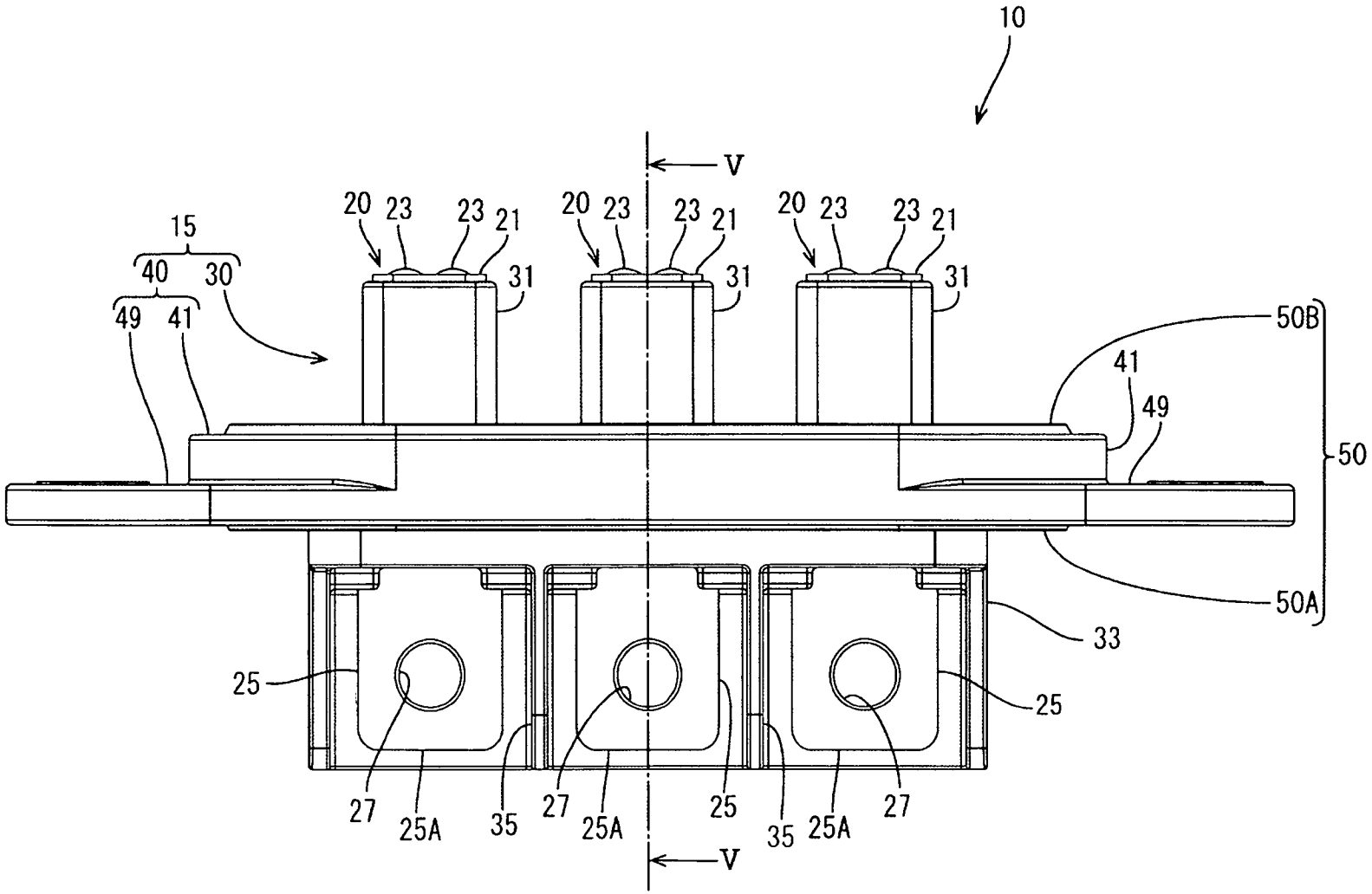
FIG. 1 is a front view of a connector according to an embodiment.
Figure 4:
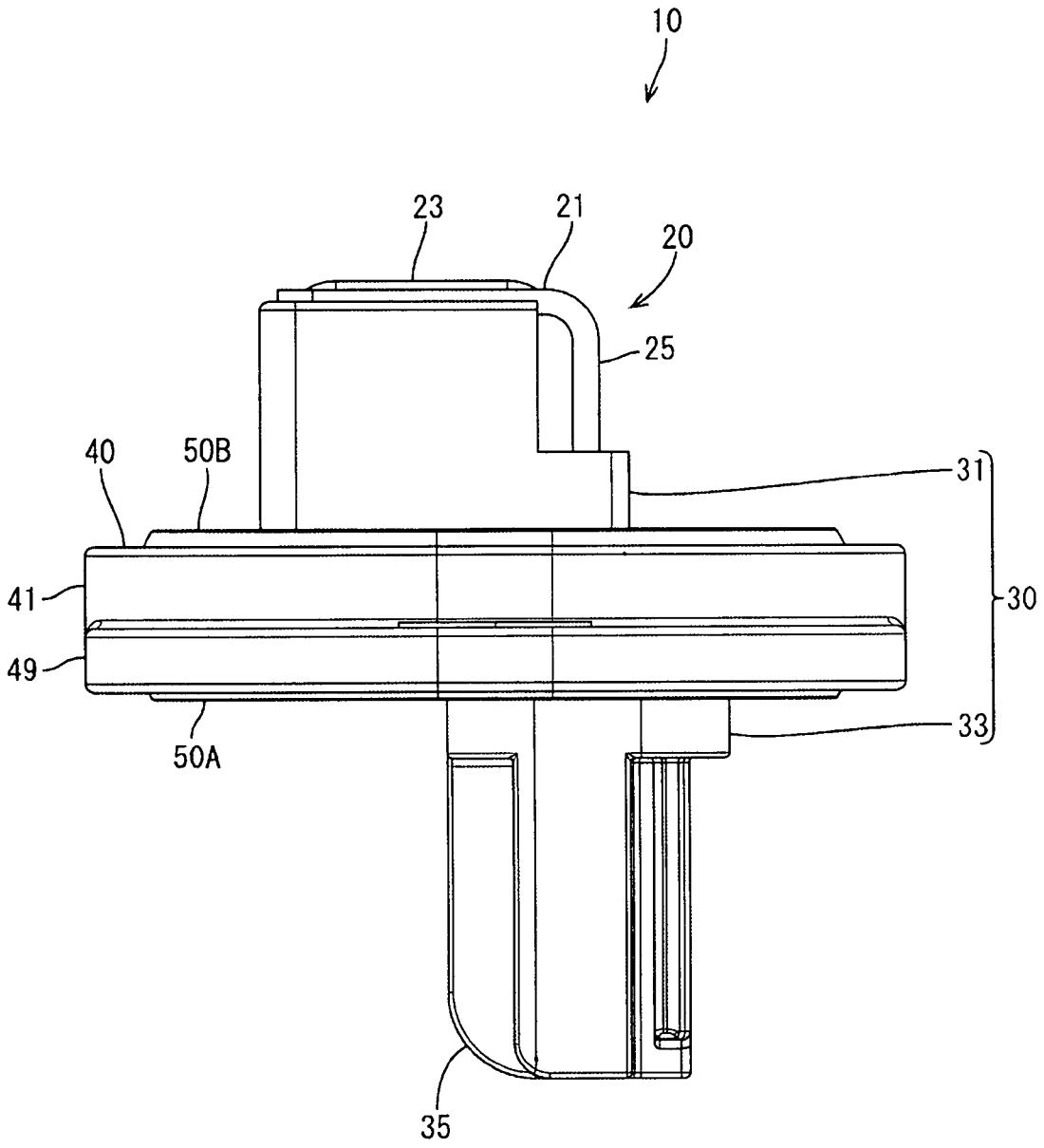
FIG. 4 is a side view of the connector.
Figure 10:
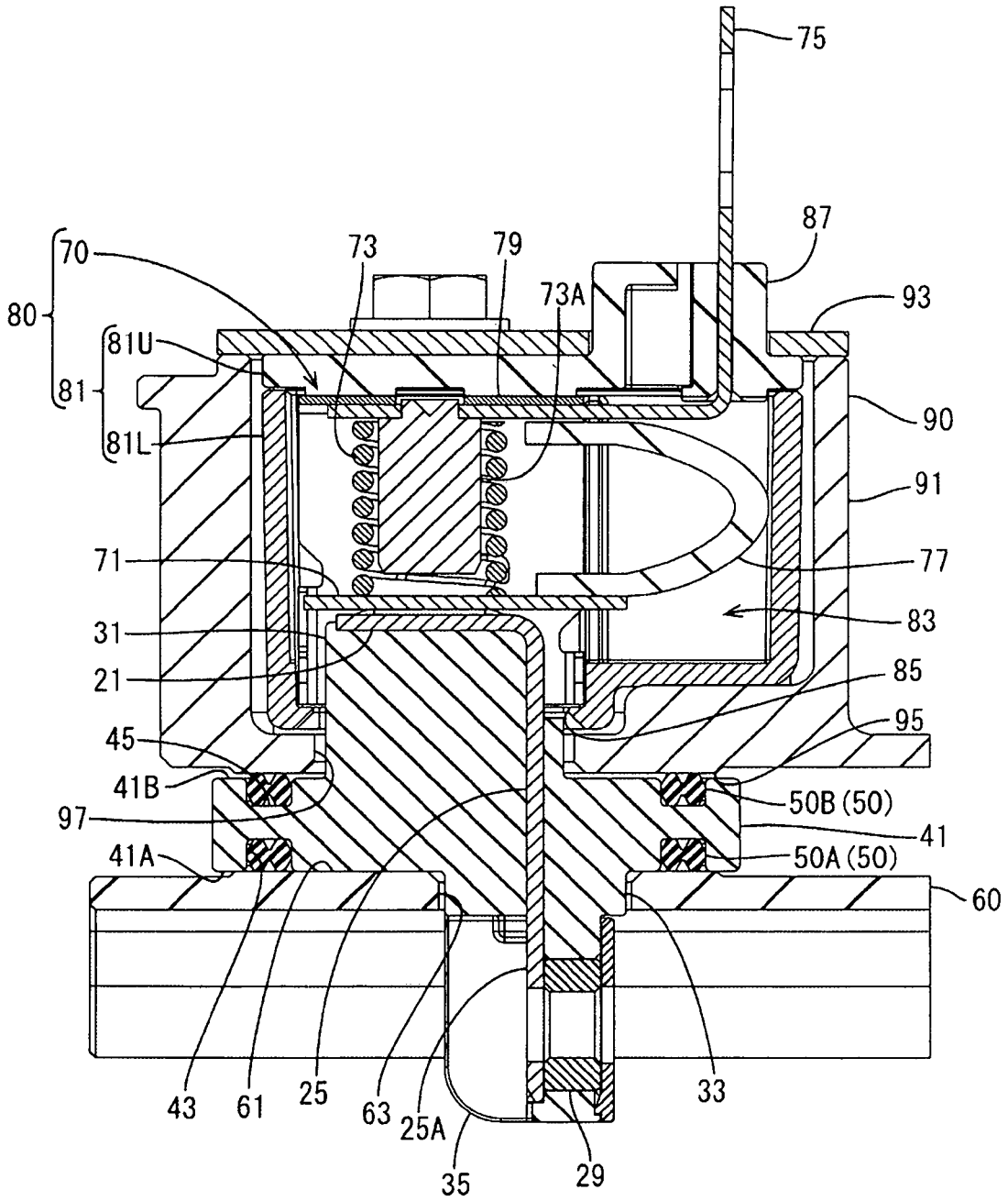
FIG. 10 is a section along X-X in FIG. 8.

As shown in FIGS. 1 and 4, the terminal holding portion 30 for holding the terminals 20 includes fittings 31 projecting farther up than the flange 40, and a terminal block 33 is provided below the flange 40. As shown in FIGS. 1 and 10, three fittings 31 project up from the upper surface of the flange 40 in conformity with the respective terminals 20 and are in the form of rectangular columns. Each fitting 31 holds the terminal 20 in a manner to expose the upper and lower surfaces of the terminal 20. Further, each fitting 31 can enter a connector opening 85 of the inverter-side connector 80.

As shown in FIGS. 1 and 10, the terminal block 33 collectively holds the lower end parts 25A of the extending portions 25 of the terminals 20. The terminal block 33 projects down from the lower surface of the flange 40, and is insertable into an opening 63 of the motor-side case 60. The terminal block 33 holds the lower parts 25A of the extending portions 25 of the respective terminals 20 in such a manner as to expose the front surfaces of the lower parts 25A, and holds the nuts 29 in a rotation stopped state. The terminal block 33 is provided with partition walls 35 for partitioning between the respective terminals 20.

Figure 2:
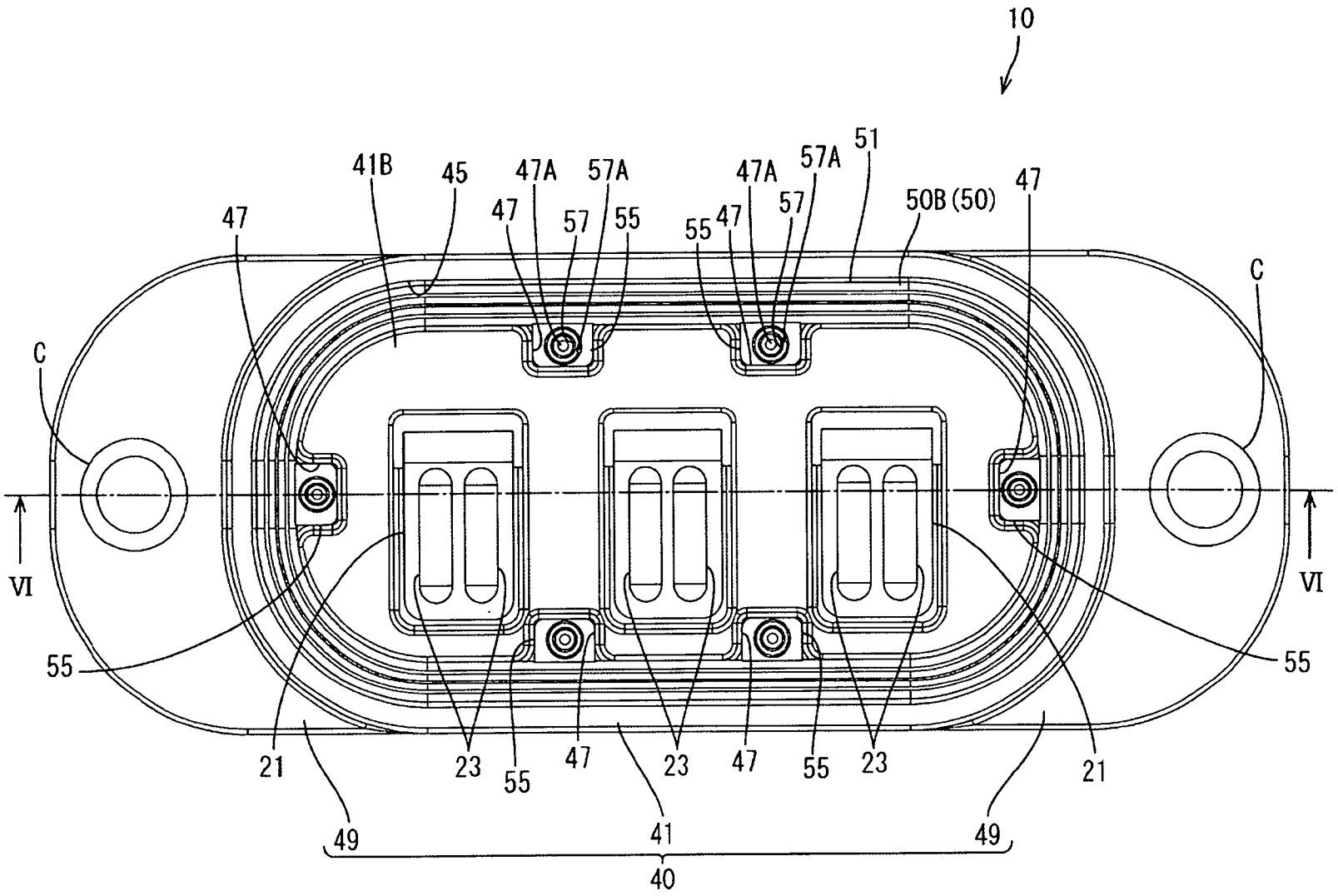
FIG. 2 is a plan view of the connector.
Figure 3:
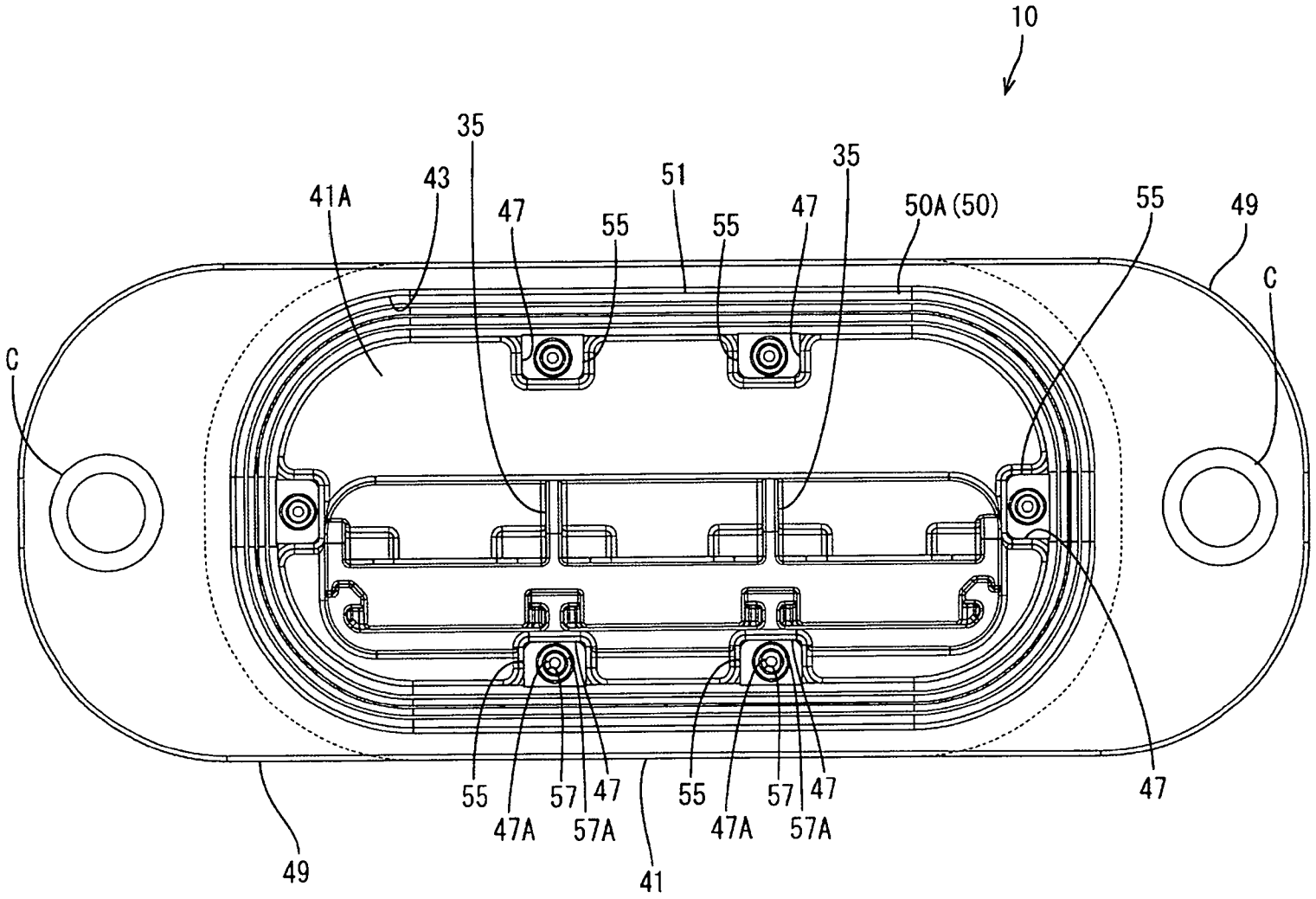
FIG. 3 is a bottom view of the connector.

As shown in FIGS. 2 and 6, the flange 40 is provided on the outer periphery of the terminal holding portion 30 and includes a flange body 41 and thin portions 49 (an example of an "area corresponding to a head part of a bolt") are provided on both lateral sides of the flange body 41. Further, the outer peripheral shape of the flange 40 in a plan view is elliptical. The flange body 41 is a flat plate with an elliptical outer peripheral shape in a plan view thereof.

A first mounting groove 43 is provided in a lower surface 41A of an outer peripheral edge part of the flange body 41, and a second mounting groove 45 is provided in an upper surface 41B. The first and second mounting grooves 43, 45 are at positions aligned in a plate thickness direction (vertical direction) of the flange body 41 and have the same shape. The mounting grooves 43, 45 have the same elliptical shape as the outer peripheral shape of the flange body 41. Further, the respective mounting grooves 43, 45 have a depth that is about ⅓ of a plate thickness of the flange body 41. The mounting groove 43, 45 is provided with locking grooves 47 at a total of six positions, i.e. one at each of central positions in the front-rear direction of both ends in the lateral direction and two between the terminals 20 on each side in a longitudinal direction (lateral direction). The locking grooves 47 have a rectangular shape in a plan view, and are provided inward of the mounting groove 43, 45 to have the same depth as the mounting groove 43, 45. A locking projection 47A projects in a center of each locking groove 47. Projecting dimensions of the locking projections 47A are equal to the depths of the mounting grooves 43, 45 so as not to project from the lower and upper surfaces 41A, 41B of the flange body 41.

Figure 11:
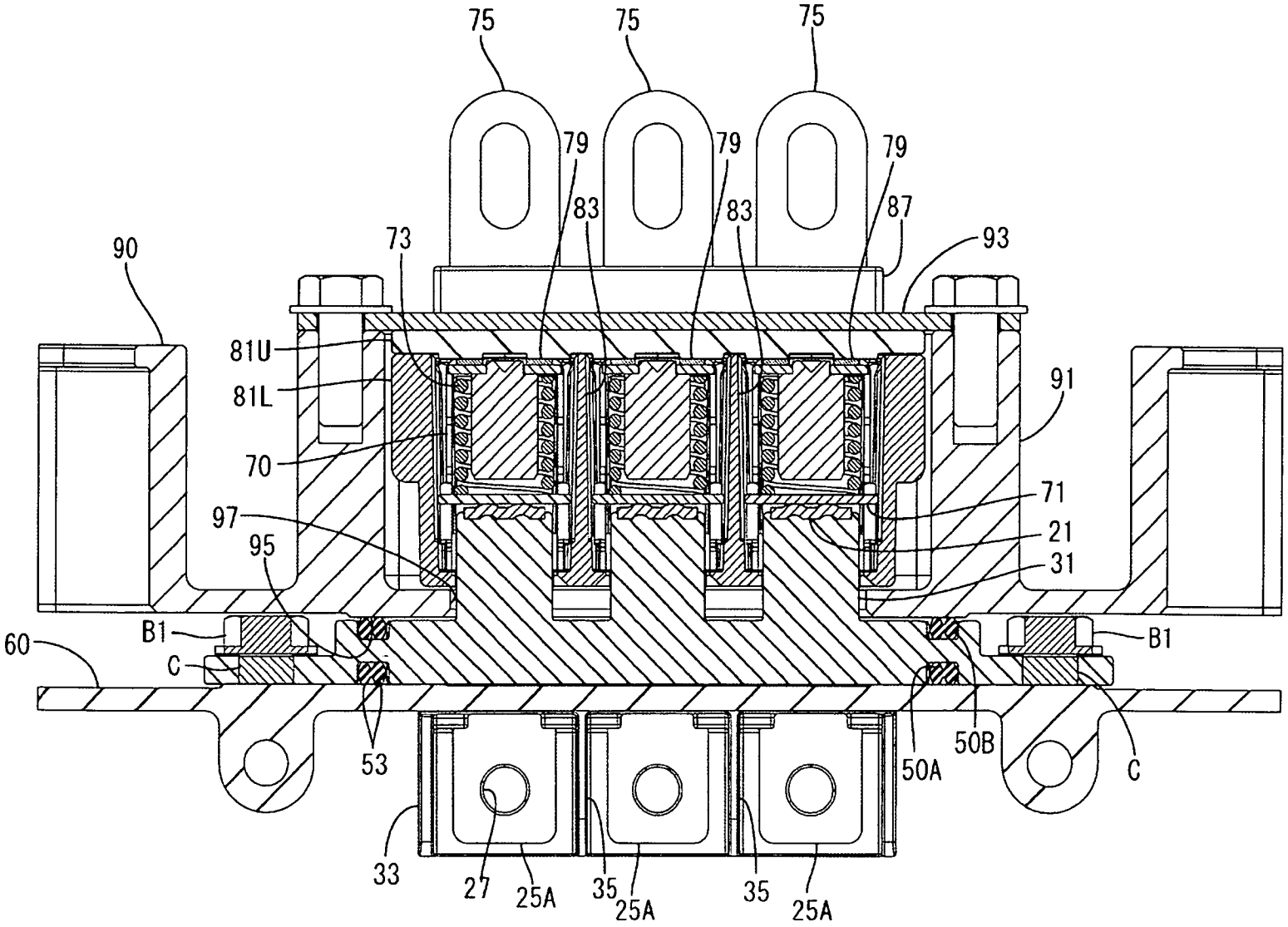
FIG. 11 is a section along XI-XI in FIG. 9.

As shown in FIGS. 2 and 11, the thin portions 49 project laterally outward of the flange body 41. The thin portions 49 are recessed downward of the flange body 41, and plate thicknesses thereof are smaller than that of the flange body 41. The upper surface positions of the thin portions 49 are located below the upper surface 41B of the flange body 41, whereas the lower surfaces of the thin portions 49 are flush with the lower surface 41A of the flange body 41. Metal collars C are insert molded into the thin portions 49, and bolts B are inserted therethrough. The collars C are provided at center positions of the respective thin portions 49 in the front-rear direction, and have a vertical dimension equal to or slightly larger than the plate thicknesses of the thin portions 49. In fixing the connector 10 to the motor-side case 60, head parts B1 of the bolts B come into contact with the upper surfaces of the collars C.

The sealing members 50 are formed of a resilient material such as rubber. As shown in FIGS. 6 and 7, each sealing member 50 to be mounted into the first mounting groove 43 is a first sealing member 50A, and the sealing member 50 to be mounted into the second mounting groove 45 is a second sealing member 50B. The first and second sealing members 50A, 50B are identical components having the same shape. Note that, in the following description, the first and second sealing members 50A, 50B are called the sealing members 50 unless being distinguished. Each sealing member 50 has the same plan view shape as the mounting groove 43, 45 and includes an elliptical sealing body 41 and six locking pieces 55 to be locked into the locking grooves 47. A width of the sealing body 51 is substantially equal to or slightly larger than a width of the mounting groove 43, 45. Further, the sealing body 51 has two lips 53 on each of the upper and lower sides, and the lip portions 53 project farther than the flange body 41 when the sealing body portion 51 is mounted into the mounting groove 43, 45. Each locking piece 55 is provided with a locking hole 57 into which the locking projection 47A is inserted, and a hole edge part 57A of the locking hole 57 is slightly thicker than other parts of the locking piece 55. Further, the sealing member 50 is disposed so that the locking pieces 55 are symmetrical with respect to a center, and the lips 53 are provided on both upper and lower surfaces. Thus, the sealing member 50 can be used without being vertically distinguished.

As shown in FIGS. 7 and 10, a smooth portion 61 projects slightly up from the upper surface of the motor-side case 60 and has a smooth surface on the upper surface of the motor-side case 60. The smooth portion 61 has the same shape as the flange 40 and has an outer peripheral shape slightly smaller than that of the flange 40. The smooth portion 61 is provided with the opening 63 into which the terminal block 33 is fit. The opening 63 has substantially the same outer peripheral shape as that of an upper end part of the terminal block 33 and a lower end part of the terminal block 33 projects into the motor-side case 60. Further, bolt holes 65 are provided at positions lateral to the opening 63 and coaxial with the collars C, and the bolts B can be engaged threadedly with the bolt holes 65.

As shown in FIGS. 10 and 11, the mating terminal 70 includes an electrical contact 71 to be brought into contact with the connecting portion 21, a coil spring 73 for biasing the electrical contact 71 down, an internal connecting portion 75 to be connected to a terminal inside the inverter-side case 90, a conductive braided wire 77 for connecting the electrical contact 71 and the internal connecting portion 75, and a case 79 for holding the electrical contact 71 and the internal connecting portion 75. The electrical contact 71 is a conductive flat metal plate. When the connecting portion 21 is butted against the electrical contact 71, the electrical contact 71 slides in contact with the connecting portion 21 while moving upward by being guided by the case 79 against a biasing force of the coil spring 73. The internal connecting portion 75 is formed by bending a conductive flat metal plate into an L shape and a shaft 73A of the coil spring 73 is fixed to a part of the internal connecting portion 75 extending in front-rear direction while the coil spring 73 is pressed against this part. A vertically extending part of the internal connecting portion 75 is provided with a long hole 75A, and bolted to the terminal in the inverter-side case 90. The case 79 is box-shaped and includes a guide portion for guiding an upward movement of the electrical contact 71, and a lower side of the case 79 is open to enable the entrance of the connecting portion 21 of the terminal 20.

The inverter-side connector 80 includes the mating terminals 70 and an inverter-side housing 81 for accommodating three mating terminals 70 arranged in the lateral direction. The inverter-side housing 81 includes a lower housing 81L provided with terminal accommodating portions 83 for accommodating the mating terminals 70 and an upper housing 81U for covering the lower housing 81L from above. The terminal accommodating portion 83 is in the form of a box open upward and can accommodate the mating terminal 70, and a lower side of the terminal accommodating portion 83 is provided with the connector opening 85 to enable the entrance of the fitting portion 31. The connector opening 85 has a larger opening than the plan view shape of the fitting portion 31 to allow entrance errors of the fitting portion 31. The lower housing 81L is formed by the terminal accommodating portions 83 being arranged in the lateral direction and accommodating the mating terminals 70 while partitioning between the mating terminals 70. The upper housing 81U is provided with a connector projecting portion 87 into which the respective internal connecting portions 75 are inserted and collectively held. By assembling the lower housing 81L and the upper housing 81U, the inverter-side housing 81 accommodates the three mating terminals 70.

As shown in FIGS. 7 and 11, the inverter-side case 90 is provided with a box-shaped connector accommodating portion 91 open in the vertical direction, and can accommodate the inverter-side connector 80. A lid 93 for covering an upper opening of the connector accommodating portion 91 can be mounted on the connector accommodating portion 91. The lid 93 covers the inverter-side connector 80 from above while allowing the connector projecting portion 87 to be inserted therethrough, and is fixed to the connector accommodating portion 91 by bolts. An inverter-side smooth portion 95 projects slightly down from the lower surface of the inverter-side case 90 and having a smooth surface. The inverter-side smooth portion 95 has the same shape as the flange body 41 and has an outer peripheral shape slightly smaller than that of the flange body 41 and slightly larger than that of the second mounting groove 45. The inverter-side smooth portion 95 is provided with an inverter-side opening 97 for exposing the connector openings 85. The inverter-side opening 97 collectively exposes the connector openings 85 and enables the entrance of the fittings 31.

The connector 10 of this embodiment is configured as described above. How to assemble the connector 10 is described.

First, as shown in FIGS. 5 and 7, the terminals 20 are formed by bending conductive metal plates into an L shape. A part of the connecting portion 21 of the terminal 20 is struck to project upward, thereby forming two contact portions 23. The connector housing 15 is molded with the terminals 20 and the collars C as inserts.

Then, as shown in FIGS. 2 and 7, the first sealing member 50A and the second sealing member 50B are mounted respectively into the first mounting groove 43 and the second mounting groove 45 of the flange body 41. Since the first and second mounting grooves 43, 45 have the same shape and the positions of the locking grooves 47 are aligned vertically, the first and second sealing members 50A, 50B can also have the same shape and need not be distinguished and molding cost and assembling cost can be reduced. Further, the sealing members 50 themselves also are shaped symmetrically and can be used without upper and lower ones being distinguished. Thus, time and labor for distinguishing the upper and lower sealing members can be saved during assembling. The sealing body portions 51 of the sealing members 50 are mounted into the mounting grooves 43, 45, and the locking pieces 55 are mounted into the locking grooves 47. By hooking the locking holes 57 of the locking pieces 55 to the locking projections 47A, the sealing members 50 are fixed in the mounting grooves 43, 45. Note that positional deviations of the sealing members 50 can be suppressed by mounting the sealing members 50 into the mounting grooves 43, 45.

Subsequently, the connector 10 is assembled with the motor-side case 60, as shown in FIGS. 7 and 10. The connector 10 is assembled from above such that the terminal block 33 thereof is fit into the opening 63 of the motor-side case 60. The lower end part of the terminal block 33 (lower end parts 25A of the extending portions 25 of the terminals 20) projects into the motor-side case 60, and the lower surface of the flange 40 (lower surface 41A of the flange body 41 and lower surfaces of the thin portions 49) comes into contact with the smooth portion 61 of the motor-side case. With the collars C aligned with the bolt holes 65, the bolts B are screwed and the head parts B1 of the bolts B come into contact with the collars C. At this time, since the collars C are disposed in the thin portions 49 and the upper surface positions of the thin portions 49 are lower than that of the flange body 41, the upper ends of the heads B1 of the bolts B are so set that the heads B1 project from the upper surface position of the flange body 41 by a short distance (equal to or shorter than a vertical dimension of the inverter-side smooth portion 95). When the bolts B are screwed into the motor-side case 60, the first sealing member 50A is held in close contact with the smooth portion 61 of the motor-side case 60 and the inner surface of the first mounting groove 43 and the lips 53 are squeezed to seal between the motor-side case 60 and the flange 40.

Figure 8:
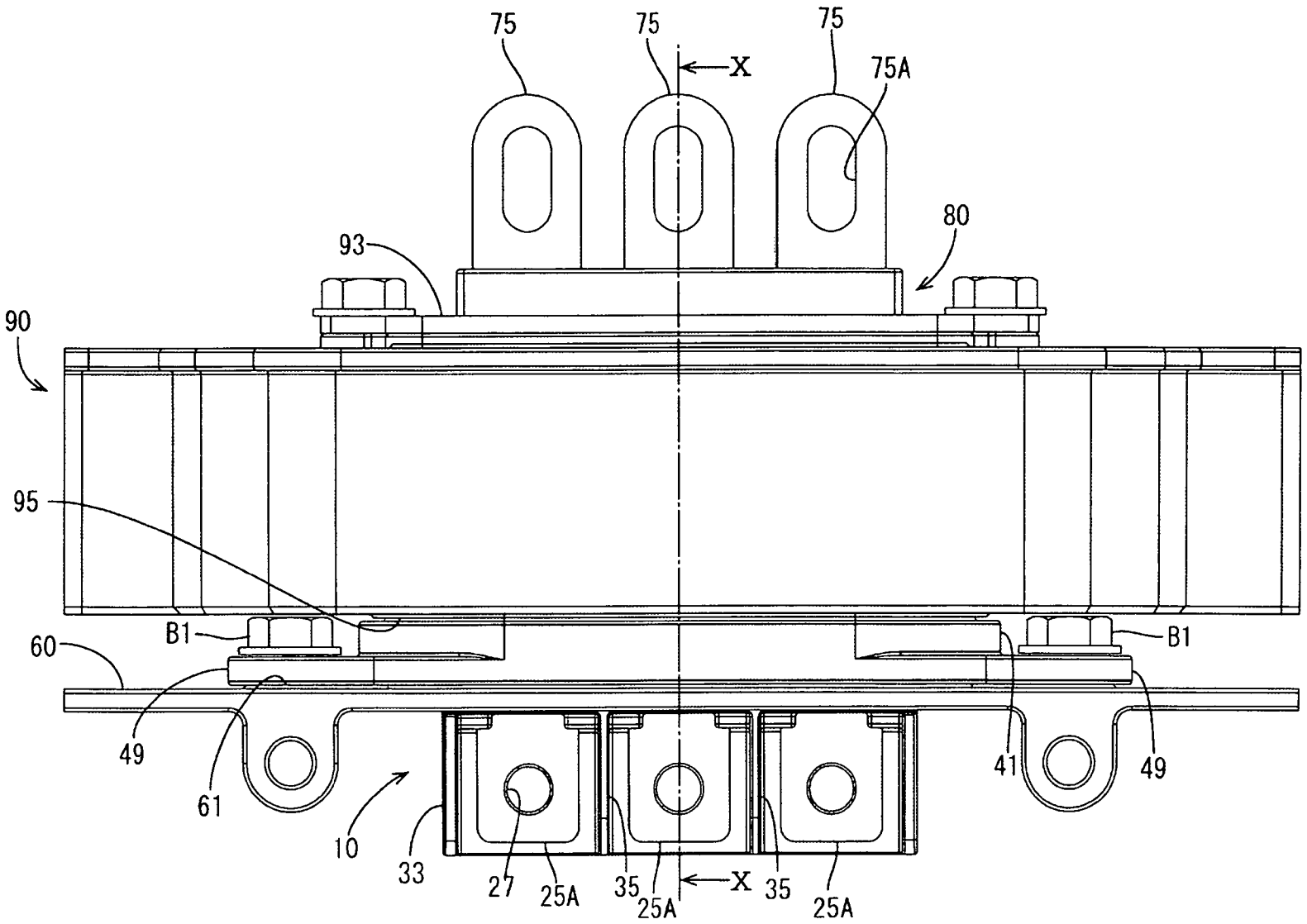
FIG. 8 is a front view of the connector in a state connected to the mating connector.
Figure 9:
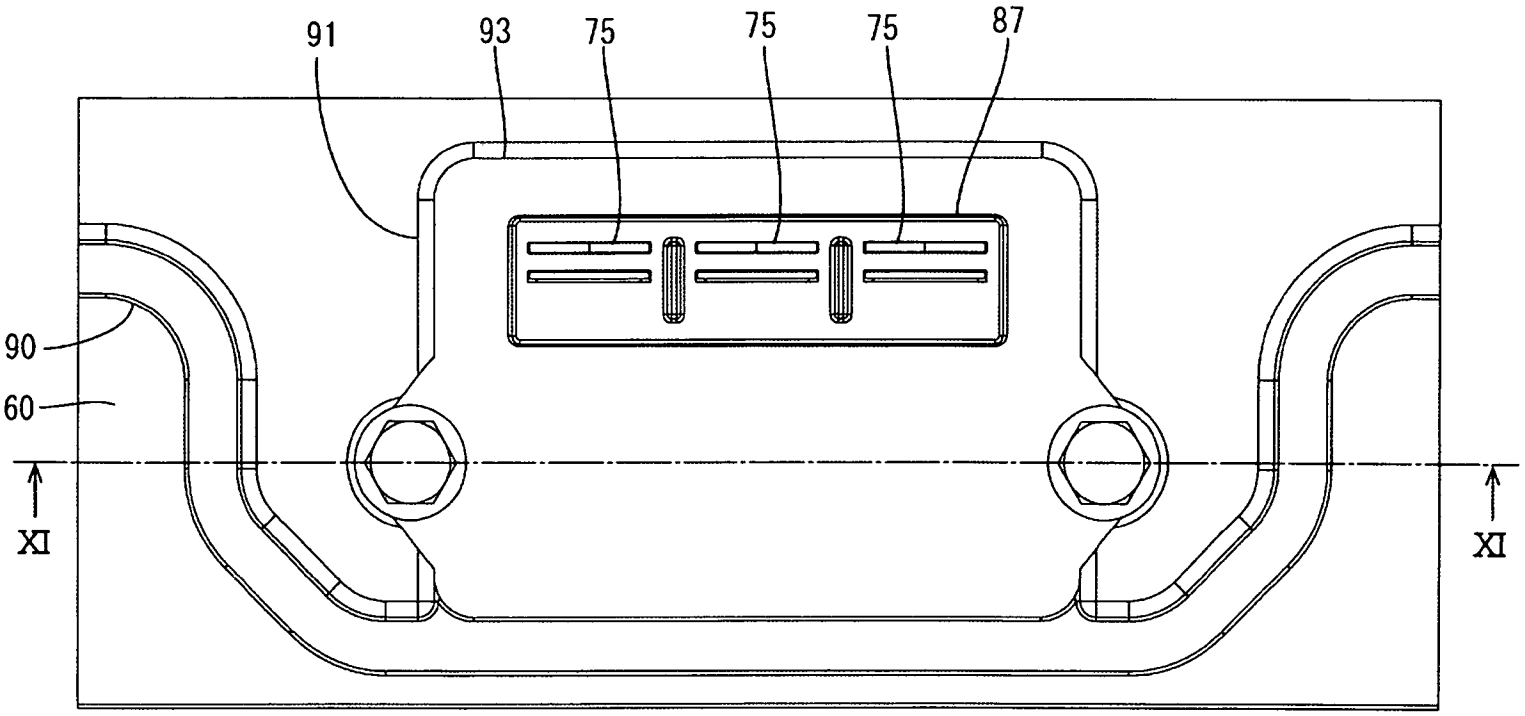
FIG. 9 is a plan view of the connector in the state connected to the mating connector.

When the connector 10 is mounted into the motor-side case 60, the inverter-side case 90 is placed on the motor-side case 60, as shown in FIGS. 7 and 8. The inverter-side case 90 is lowered to align the positions of the connector 10 and the inverter-side connector 80. Then, the fittings 31 of the connector 10 enter the connector openings 85. Inner dimensions of the connector openings 85 are larger than outer dimensions of the fittings 31. Thus, slight entrance errors are allowed, and a precise alignment is not necessary in connecting the connector 10 and the inverter-side connector 80.

The connecting portions 21 of the terminals 20 come into contact with the electrical contact members 71 of the mating terminals 70 and slide in contact with the electrical contact members 71 while pushing the electrical contact members 71 up so that the mating terminals 70 and the terminals 20 are connected. The terminals 20 and the mating terminals 70 are connected by being butted against each other, and the connecting portions 21 and the electrical contact members 71 have certain butting areas. Thus, a precise alignment is not necessary.

Subsequently, the motor-side case 60 and the inverter-side case 90 are joined. The inverter-side case 90 and the motor-side case 60 are joined by fixing the lower surface of the inverter-side case 90 and the upper surface of the motor-side case 60 at a plurality of positions, such as at four corners by bolts. Even when the inverter-side case 90 is joined, the inverter-side case 90 does not interfere with the bolts B even if the inverter-side case 90 is not provided with escapes for the bolts B since the bolts B project from the upper surface 41B of the flange body 41 only by a dimension within the vertical dimension of the inverter-side smooth portion 95. Further, the second sealing member 50B is held in close contact with the inverter-side smooth portion 95 of the inverter-side case 90 and the inner surface of the second mounting groove 45 and the lips 53 are squeezed to seal between the inverter-side case 60 and the flange 40.

When the inverter-side case 90 is joined to the motor-side case 60, the flange 40 is sandwiched between the motor-side case 60 and the inverter-side case 90. The sealing members 50 mounted on both upper and lower surfaces of the flange 40 provide sealing while being squeezed between the respective cases 60, 90 and the mounting grooves 43, 45. At this time, since the sealing members 50 are squeezed by the outer surfaces of the cases 60, 90, a precise alignment is not necessary, unlike shaft seals. Further, since the upper and lower sealing members 50 are mounted at the same position on the flange body 41, resilient forces of the squeezed sealing members 50 are applied to the flange 40 in the same manner from both sides in the plate thickness direction of the flange 40 and cancel each other. Thus, deformation of the flange 40 can be suppressed and the degradation of sealing performance due to the deformation of the flange 40 can be prevented.

As described above, in the connector 10 of this embodiment, the sealing members 50 are respectively mounted on the both surfaces of the flange 40. The respective sealing members 50 provide sealing while being squeezed between the respective cases 60, 90 and the flange 40. Since the mounted positions of the first and second sealing members 50A, 50B are aligned in an overlapping direction (vertical direction) of the motor and the inverter, resilient forces of the squeezed sealing members 50 are applied to the flange 40 in the same manner from both sides in the plate thickness direction of the flange 40 and cancel each other. Thus, deformation of the flange 40 caused by the resilient forces of the sealing members 50 can be suppressed, a member for preventing the deformation of the flange 40 becomes unnecessary, and the number of components can be reduced. Further, since sealing is provided between the flange 40 and the respective cases 60, 90 by surface seals, a precise alignment is not necessary unlike shaft seals. Thus, an aligning mechanism becomes unnecessary and miniaturization and a cost reduction can be realized. Further, since the surfaces (smooth portions 61, 95) of the cases 60, 90 to be held in close contact with the sealing members 50 are the outer surfaces of the cases 60, 90 and a process for polishing outer surfaces is less costly than a process for polishing inner surfaces, cost can be further reduced.

The invention is not limited to the above described embodiment. For example, the following modes also are included.

Although the sealing members 50 are mounted in the mounting grooves 43, 45 in the above embodiment, the sealing members 50 may be mounted on the surfaces (upper and lower surfaces) of the flange body without being mounted into the mounting grooves 43, 45.

Although the first and second sealing members 50A, 50B have the same shape in the above embodiment, the first and second sealing members 50A, 50B may have different shapes.

Although the collars C are provided in the thin portions 49 in the above embodiment, the thin portions 49 may not be provided and collars may be provided in parts having the same plate thickness as the flange body.

Although the terminal 20 and the mating terminal 70 are connected by being butted against each other in the above embodiment, a pin-like male terminal and a tubular female terminal may be axially aligned and connected.

LIST OF REFERENCE SIGNS

10 . . . connector
15 . . . connector housing
20 . . . terminal
30 . . . terminal holding portion
31 . . . fitting portion
33 . . . terminal block
40 . . . flange
41 . . . flange body
41A . . . lower surface
41B . . . upper surface
43 . . . first mounting groove
45 . . . second mounting groove
47 . . . locking groove
47A . . . locking projection
49 . . . thin portion (area corresponding to head of bolt)
50 . . . sealing member
50A . . . first sealing member
50B . . . second sealing member
60 . . . motor-side case (case of first device)
61 . . . smooth portion
63 . . . opening
70 . . . mating terminal

80 . . . inverter-side connector (mating connector)
81 . . . inverter-side housing
85 . . . connector opening
90 . . . inverter-side case (case of second device)
95 . . . inverter-side smooth portion
97 . . . inverter-side opening
C . . . collar
B . . . bolt
B1 . . . head part

The invention claimed is:

1. A connector connecting structure for connecting a connector mounted in an opening of a case of a first device and a mating connector mounted in a case of a second device and to be connected to the connector by overlapping and fixing the first device and the second device, wherein:

the connector includes:

a terminal holding portion configured to hold three terminals;

a flange in the form of a flat plate, provided on an outer periphery of the terminal holding portion and to be sandwiched between the case of the first device and a case of the second device, the flange including a flange body in the form of a flat plate with opposed upper and lower surfaces continuously provided to an outer surface of the terminal holding portion and thin portions provided on both sides in a terminal arrangement direction in the flange body, the thin portions having lower surfaces continuous with the lower surface of the flange body, and upper surfaces recessed below the upper surface of the flange body to define a flange recess, each of the thin portions having a throughhole with a collar disposed therein;

a bolt extending through each of the collars and fixing the flange to the case of the first device, the bolt having a head arranged in the flange recess so as not to project above the upper surface of the flange body;

a first sealing member mounted on the lower surface of the flange body on the side of the first device and configured to seal between an outer surface of the case of the first device and the flange;

a second sealing member mounted on the upper surface of the flange body on the side of the second device and configured to seal between an outer surface of the case of the second device and the flange;

mounted positions of the first sealing member and the second sealing member are aligned in an overlapping direction of the first device and the second device;

a smooth portion on the first device side slightly projecting toward the flange, having a smooth surface and to be held in close contact with the first sealing member is provided on the outer surface of the case of the first device; and a smooth portion on the second device side slightly projecting toward the flange, having a smooth surface and to be held in close contact with the second sealing member is provided on the outer surface of the case of the second device.

2. The connector connecting structure of claim 1, wherein the first sealing member and the second sealing member have the same shape.

3. The connector connecting structure of claim 1, wherein the terminal held in the terminal holding portion is connected to a mating terminal held in the mating connector by being butted against the mating terminal.

4. The connector connecting structure of claim 1, wherein upper and lower mounting grooves are recessed into the upper and lower surfaces of the flange body, and the first and second sealing members are at least partially accommodated individually in one of the upper and lower mounting grooves.

5. The connector connecting structure of claim 1, wherein the first and second sealing members are identical to each other.

6. The connector connecting structure of claim 4, wherein the upper and lower mounting grooves are vertically aligned with each other.

7. The connector connecting structure of claim 4, wherein at least one lock is formed in each of the upper and lower mounting grooves, and the first and second sealing members are lockably engaged in the mounting grooves.

8. The connector connecting structure of claim 7, wherein the at least one lock in the upper mounting groove and the at least one lock in the lower mounting groove are vertically aligned with each other.

9. The connector connecting structure of claim 8, wherein the first and second sealing members are identical to each other.

* * * * *